US007725979B1

(12) United States Patent
Held et al.

(10) Patent No.: US 7,725,979 B1
(45) Date of Patent: Jun. 1, 2010

(54) BABY-WIPE MITT

(76) Inventors: Melanie Held, 24 Wythe Ct., Apt. 212, Fairfield, OH (US) 45014; Woody Keith, 24 Wythe Ct., Apt. 212, Fairfield, OH (US) 45014

( * ) Notice: Subject to any disclaimer, the term of this patent is extended or adjusted under 35 U.S.C. 154(b) by 939 days.

(21) Appl. No.: 11/373,625

(22) Filed: Mar. 13, 2006

(51) Int. Cl.
*A47K 7/02* (2006.01)
*A47K 7/03* (2006.01)
*A47L 13/18* (2006.01)
*A47L 13/19* (2006.01)

(52) U.S. Cl. ..... 15/104.94; 15/227; 2/158; 2/159; 2/161.6

(58) Field of Classification Search ..... 15/104.94, 15/227; 2/158, 159, 161.6, 161.8, 164, 167
See application file for complete search history.

(56) References Cited

U.S. PATENT DOCUMENTS 4,788,733 A * 12/1988 Lerner ..... 15/104.94
4,902,283 A 2/1990 Rojko et al.
4,959,881 A 10/1990 Murray
D418,954 S 1/2000 Ferdenzi
6,018,837 A 2/2000 Andreu
6,115,873 A * 9/2000 Dunkley ..... 15/227
6,145,155 A 11/2000 James et al.
6,516,469 B1 2/2003 Schaetzel
6,811,338 B1 * 11/2004 Manske, Jr. et al. ..... 401/7
2005/0217045 A1 * 10/2005 Minkler et al. ..... 15/104.94

FOREIGN PATENT DOCUMENTS

EP 409802 * 1/1991
FR 2813777 * 3/2002
JP 7-284467 * 10/1995
JP 2003-52599 * 2/2003
JP 2003-284651 * 10/2003
JP 2005-66275 * 3/2005

OTHER PUBLICATIONS

Translation of FR2813777, published Mar. 15, 2002.*

* cited by examiner

*Primary Examiner*—Mark Spisich
(74) *Attorney, Agent, or Firm*—Crossley Patent Law; Mark A. Crossley

(57) ABSTRACT

A baby-wipe mitt comprising an outer absorbent layer, with an added inner highly absorbent layer, both premoistened with anti-bacterial and anti-fungal agents, the inner lining an impermeable plastic lining extending beyond the outer layer, covering at least part of a user's wrist for further protection is disclosed. The mitt has an elastic band that encircles the wrist of a user. The mitt features opposed digit surrounds to allow easy cleaning of crevices. The mitt features a special non-abrasive pad on digit surround.

10 Claims, 4 Drawing Sheets

BABY-WIPE MITT

BACKGROUND THE INVENTION

Various products are available for cleaning a baby's bottom of defecation or urine, or for cleaning a baby or an older individual anywhere on their body. A plethora of issues are faced in addressing the cleaning issues. Among the issues are (a) absorbency, (b) single layer devices through which undesirable materials can migrate, (c) wipes that are difficult to grasp, and especially grasp while maintaining a sanitary cleaning effort, (d) devices which do not properly shield a user from contamination associated with such cleaning efforts, and (e) inability to use one's digits in cleaning. Standard mitts, for example, do not allow the human dexterity needed in such tasks, even if a thumb surround is included. Standard scouring mitts, by their very nature, cannot offer the gentleness and features needed in cleaning a human, and more especially an infant. The present invention offers unique solutions to these issues that, while basic, have previously been cumulatively overlooked.

FIELD OF THE INVENTION

The present invention relates to disposable absorbable cleaning and wiping devices and more specifically to a baby-wipe mitt for cleaning a baby's bottom and pelvis areas. The device may also be used in cleaning other individuals in need of assistance.

SUMMARY OF THE INVENTION

The general purpose of the baby-wipe mitt, described subsequently in greater detail, is to provide a baby-wipe, mitt which has many novel features that result in an improved baby-wipe mitt which is not anticipated, rendered obvious, suggested, or even implied by prior art, either alone or in combination thereof.

To accomplish this, the mitt offers distinctive features over other sanitization devices known in the field. The sanitary mitt is partially made of the same material similar to that used to form well known baby wipes but includes further advantages. A most basic example of the invention includes only two layers. The outer layer is the above-mentioned standard absorbent layer, typically premoistened with propylene-glycol, and lanolin in a water base. Other anti-bacterial and anti-fungal ingredients are also used. The inner lining, though, is an impermeable plastic lining. The inner lining is highly flexible, much like a surgeon's glove, thereby affording complete dexterity. The lining prevents urine, feces, and other undesirable materials from entering the mitt.

Yet, the outer layer which contacts skin is of soft pliant absorbent materials. The plastic impermeable lining extends beyond the outer layer, covering at least part of a user's wrist, thereby offering further protection against undesired material invasion. The plastic lining extension also aids in reversing the invention, after use, without soiling hands. The lining does so by extending beyond the absorbent layer, offering a grasp for mitt removal and an aid in reversal to an inside-out position for the mitt, thereby containing any soiling materials within the reversed mitt. This enables more sanitary disposal of the mitt after use. Further, each mitt has an elastic band that encircles the wrist of a user, so that the mitt does not easily come off of the hand, a noted problem with other devices. The elastic band also assists in containing offensive material within the mitt after use and reversal to an inside-out state.

The most basic mitt is ambidextrous, so either a right or left handed person can easily use the mitt. The ideal mitt includes three layers—an outer absorbent layer, a highly absorbent layer just inside the outer layer, and an inner impermeable lining which fits the user's hand. The mitts are offered in individual, dual, or multiple packs.

Key features of the preferred mitt are the separate digit surrounds. A more basic version of the mitt offers a separate thumb surround for a user. The preferred mitt embodiment, though, has a mitt portion and surrounds for both a thumb and an additional, opposed digit. Cleaning an individual, especially a baby, requires significant dexterity not offered with a typical mitt design. Including just one digit surround, such as one for a thumb, cannot alleviate this problem.

But, including the design in the present mitt which offers a surround for two individual digits provides for opposed thumb and finger interaction, the very trait that sets humans apart from virtually all other animals. Opposed digit interaction between thumb and finger enables a human to perform tasks that other animals cannot. The present mitt considers this valuable trait of the human body, thereby assisting in personal sanitation with greater efficiency and less exposure to undesirable urine, feces, and the like. An even further advantage offered by the present mitt is that the thumb and digit surrounds are preferably equipped with a double absorbent layer. It is often necessary to carefully clean between a baby's small bottom cheeks, and this is also where additional fecal matter gathers. The double absorbent layer provides the material needed to completely clean a baby, or other individual, seldom with the need to use a second cleaning device. Additionally, a more complete example of the mitt features a double absorbent layer throughout. This feature negates, in most cases, the use of several absorbent wipes per cleaning, which is a very common, complaint when trying to clean a baby or even an individual, as devices typical in the art are not sufficiently absorbent. The preferred example of the mitt features the outer absorbent layer with a next layer within being the highly absorbent inner layer. The impermeable lining is therefore fitted around the hand and digits of the user, with the absorbent layers exposed for use. The highly absorbent inner layer wicks moisture away from the outer absorbent layer, thereby serving to make the mitt more useful for increased messes and moisture from urine, and the like. The dual absorbent construction is therefore of significant value.

The extra digit surround is opposed to the thumb surround. Additionally, the foremost example of the mitt provides a unique feature on the extra digit surround. The outer layer of the extra digit surround is made of a non-abrasive absorbent pad that is specifically designed to clean extremely delicate areas, especially those of a baby or infant. Such areas, as around genitalia and anus are particularly prone to irritation and rash. The special non-abrasive, softly textured pad helps to alleviate such problems. With these advantages, the present mitt is also more user friendly to any person using the device upon their own person.

After use, the disposable mitt is preferably just inverted and discarded. The plastic lining, now on the outside of the mitt, is a protection shield to further guard against the spread of bacteria and disease. The elastic wrist band aids in the same by assisting in containing the spread of undesirable materials within the inverted mitt. The mitt's use is limited by imagination only, as other cleanup needs are encountered in a variety of situations. The mitt is offered in different colors and scents. Day care centers, hospitals, baby-sitting services, nursing homes—these and more institutions can easily benefit from the advantages of the present mitt.

Thus has been broadly outlined the more important features of the baby-wipe mitt so that the detailed description thereof that follows may be better understood and in order that the present contribution to the art may be better appreciated.

Numerous objects, features and advantages of the baby-wipe mitt will be readily apparent to those of ordinary skill in the art upon reading the following detailed description of presently preferred, but nonetheless illustrative, examples of the baby-wipe mitt when taken in conjunction with the accompanying drawings.

In this respect, before explaining the current examples of the baby-wipe mitt in detail, it is to be understood that the mitt is not limited in its application to the details of construction and arrangements of the components set forth in the following description or illustration. The mitt is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the baby-wipe mitt. It is therefore important that the claims be regarded as including such equivalent constructions insofar as they do not depart from the spirit and scope of the present baby-wipe mitt.

Objects of the baby-wipe mitt, along with various novel features that characterize the mitt are particularly pointed out in the claims forming a part of this disclosure. For better understanding of the baby-wipe mitt, its operating advantages and specific objects attained by its uses, refer to the accompanying drawings and description.

A is the preferred example, with the mitt featuring both the thumb surround and opposed digit surround, the digit surround complete with the non-abrasive pad.

B is the single thumb surround embodiment.

C is the basic mitt embodiment.

Figure 1:
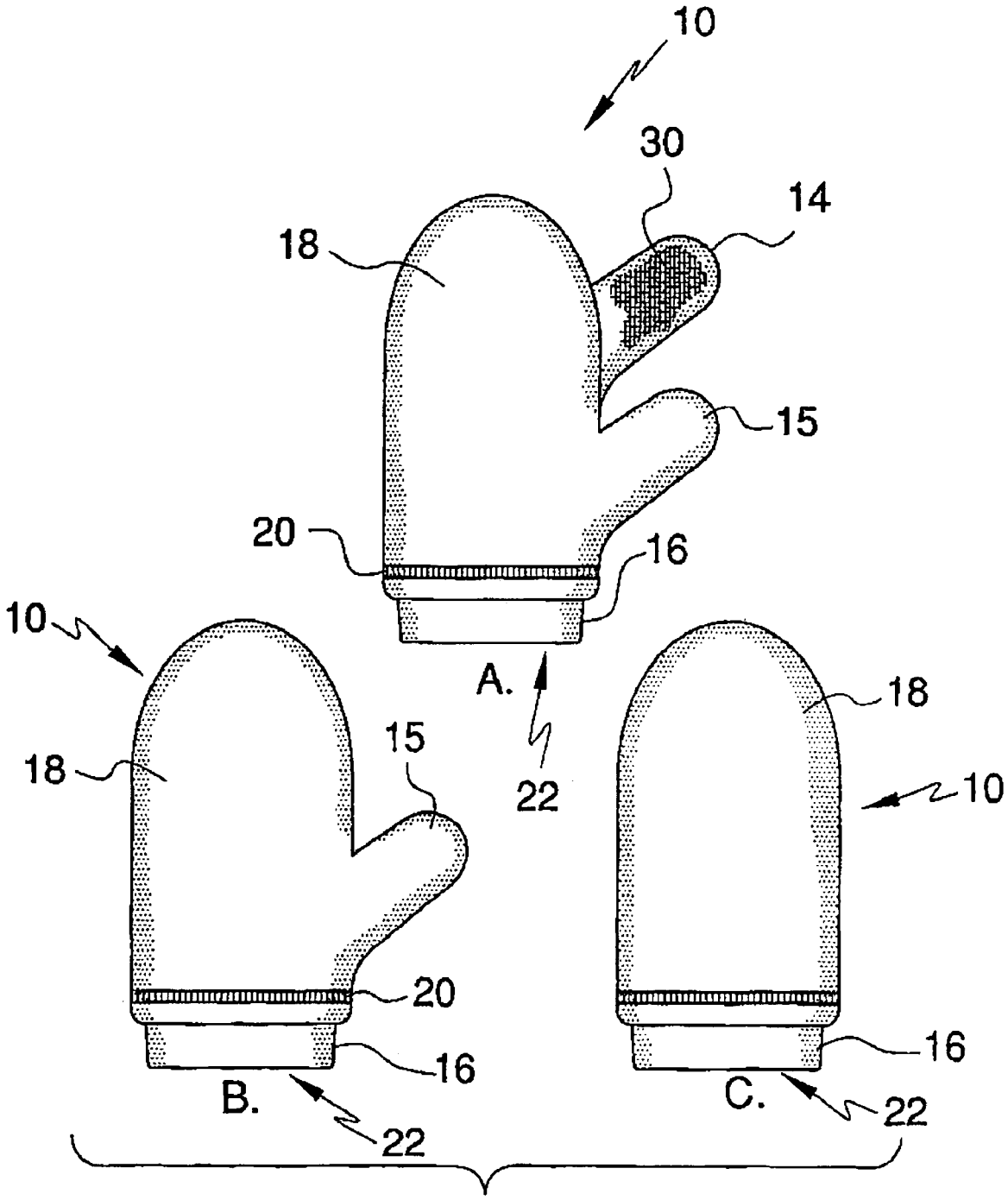
FIG. 1 is a front elevation view of three embodiments as follows.
Figure 2:
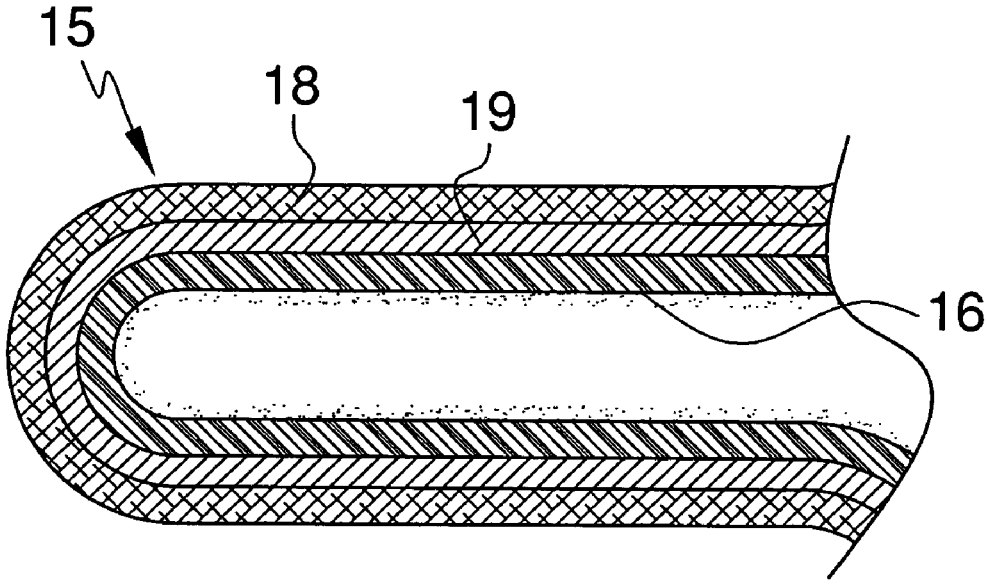

FIG. 2 is a cross sectional view of the thumb surround of embodiments A and B of FIG. 1.

Figure 3:
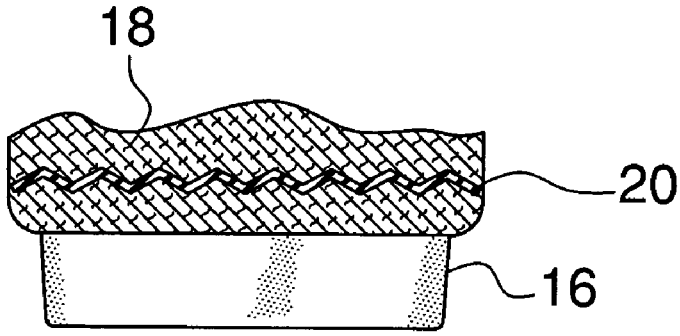

FIG. 3 is a partial front elevation view of the extension of the impermeable lining beyond the elastic wrist band.

Figure 4:
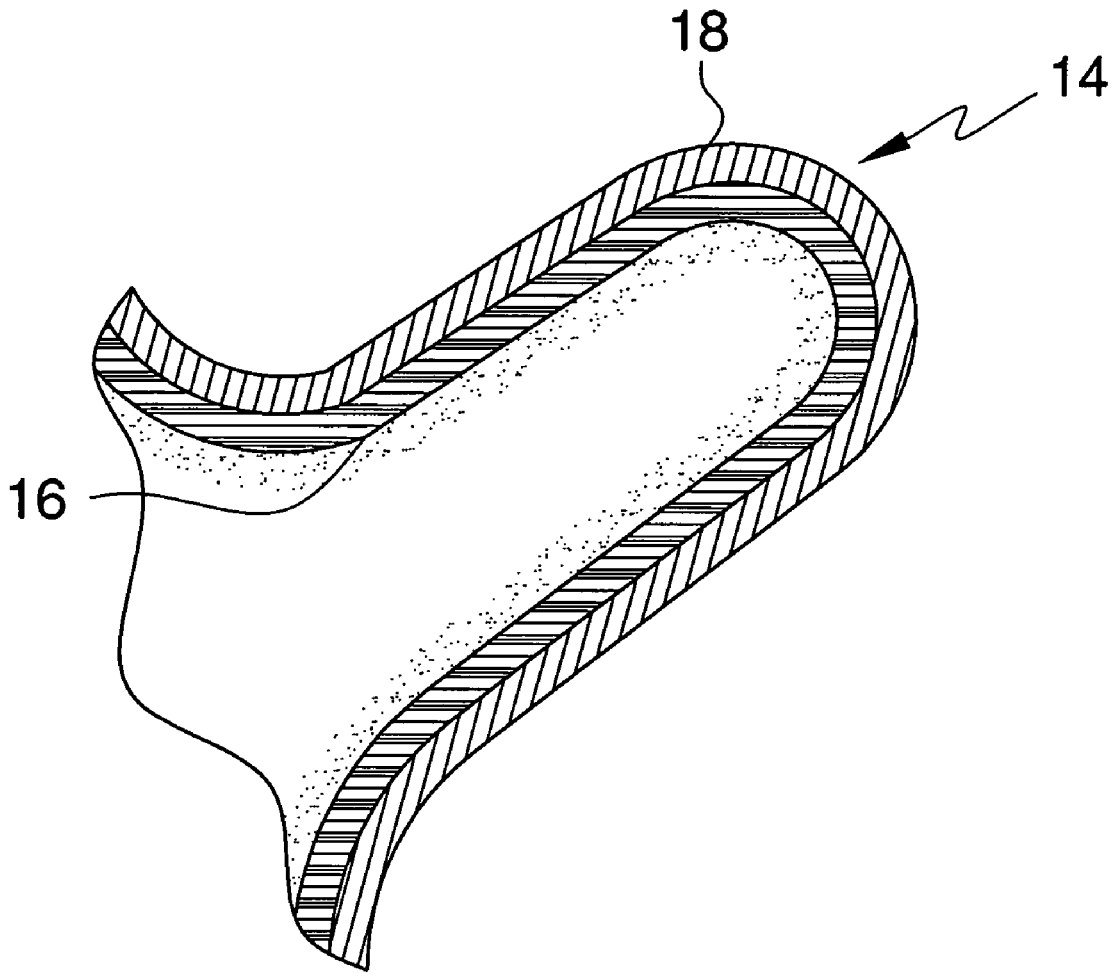

FIG. 4 is a partial cross sectional view of the most basic form of the thumb surround, illustrating only two layers.

Figure 5:
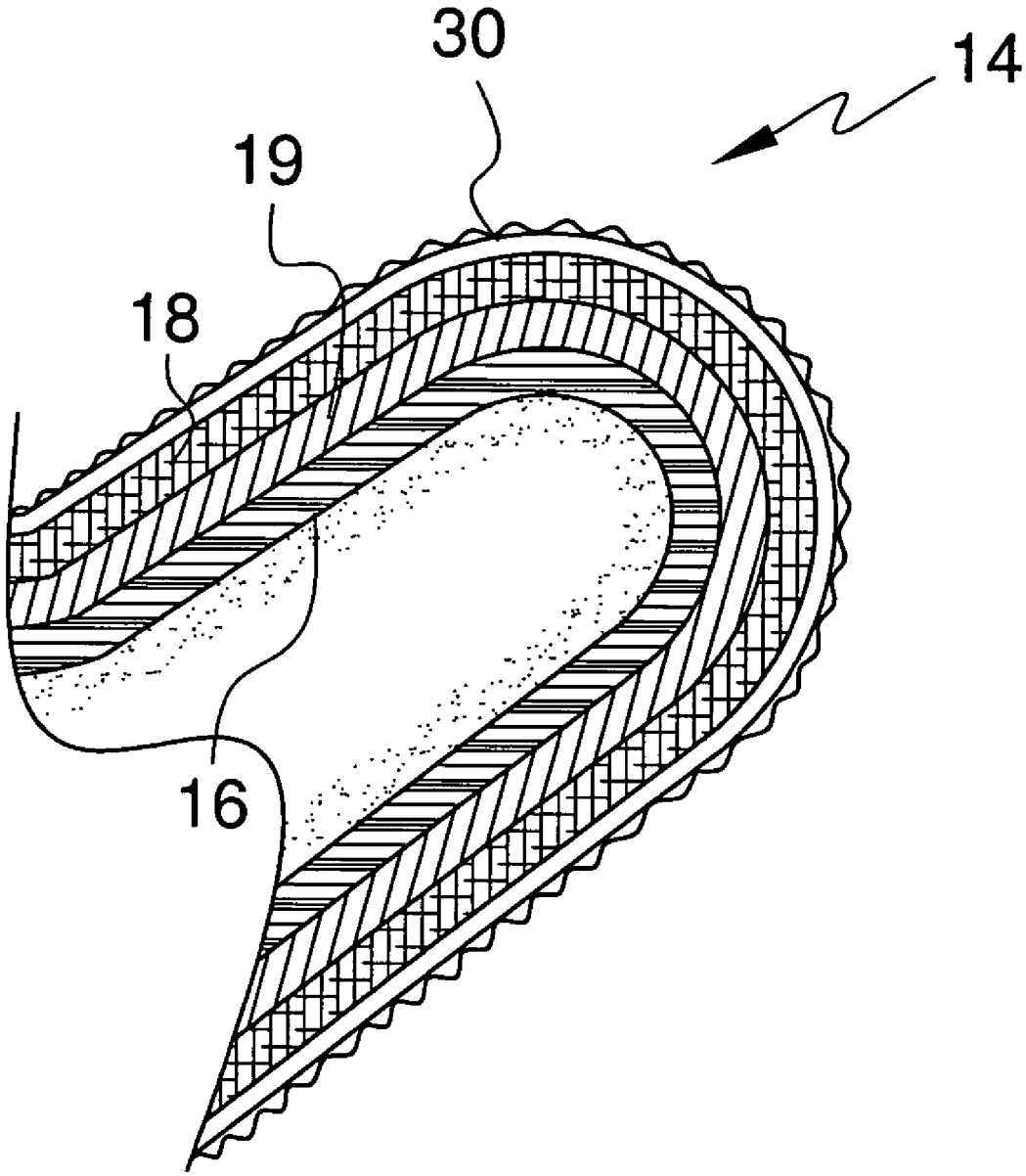

FIG. 5 is a cross sectional view of the digit surround of embodiment A of FIG. 1, illustrating the preferred example complete, with non-abrasive pad.

DETAILED DESCRIPTION OF THE DRAWINGS

With reference now to the drawings, and in particular FIGS. 1 through 5 thereof, examples of the baby-wipe mitt employing the principles and concepts of the mitt and generally designated by the reference number 10 will be described.

Referring to FIG. 1, the invention comprises a mitt 10. The outer layer 18 is comprised of a flexible absorbent layer 18 of appropriate material. Such materials are known in the art and are referenced in the summary. The mitt 10 further comprises a first flexible inner lining 16 of an impermeable material. The highly flexible inner impermeable lining 16 is similar to a surgeon's glove, in that total dexterity is offered in use of the mitt 10. The impermeable lining layer 16 extends to cover the wrist of a user. The preferred example of the mitt 10 features double absorbent layers, with absorbent layer 18 outermost and highly absorbent layer 19 inside the outer layer 18 (FIG. 2). The opening 22 at a bottom of the mitt 10 is for the removable insertion of an individual's hand. The most basic example of the mitt 10 in embodiment C in FIG. 1 receives the entire hand of an individual. The example of the mitt 10 (embodiment B in FIG. 1) receives the hand of an individual within the mitt 10 with a thumb surround 15 for receipt of an individual's thumb. In the preferred example of the mitt 10 (embodiment A in FIG. 1), the larger first portion of mitt 10 is for receiving more than one finger of an individual. The thumb surround 15 is angularly joined to the first portion of the mitt 10. A second digit surround 14 is for the removable receipt of a second digit of the hand, the second digit opposed to the thumb.

The importance of the two opposed digit surrounds, thumb surround 15 and digit surround 14 cannot be overstated. The very nature of the human hand features opposed digits, offering the greatest dexterity of the animal world. Each of us who has attempted to clean a baby or individual without the clear use of at least two opposed digits understands the frustration involved, and that frustration increases when dealing with excrement. Even more advantageous in the preferred example of the mitt 10 is the non-abrasive pad 30 featured on the digit surround 14 opposed to the thumb surround 15 (embodiment A in FIG. 1). As described, cleaning delicate areas, especially around genitalia and anus of an infant can not only be crucial to cleanliness, but also requires significant sensitivity to avoid irritation and aggravation to those areas. The non-abrasive pad 30 is mildly textured for greater effectiveness in absorption and cleaning. The outer layer 18 of absorbent material of the mitt 10 is also preferably treated with moist anti-bacterial and anti-fungal agents. The highly absorbent layer 19 and the pad 30 are also optionally treated. Various anti-bacterial and anti-fungal agents are used in various examples of the mitt 10. These agents are well known in the art of personal hygiene and sanitization. The inner impermeable lining 16 extends beyond and above an individual's wrist, thereby offering protection against invasive materials. An elasticized material referred to as an elastic band 20 encircles an approximate base of the mitt 10, proximal to the end of the absorbent layer 18. The elastic band 20 is proximal to the user's wrist.

Still a more complete example of the mitt 10 features absorbent layer 18 and highly absorbent layer 19 throughout the exterior of the mitt 10. A somewhat less complete example offers both absorbent layer 18 and highly absorbent layer 19 on the thumb surround 15 and digit surround 14 only.

Referring to FIG. 2, the thumb surround 15 is illustrated with the outer absorbent layer 18 and inner highly absorbent layer 19. The highly absorbent layer 19 wicks moisture away from the outer absorbent layer 18, thereby rendering the mitt 10 an extended use life. Double absorbency is ideal when cleaning not only infants but other individuals. Top, many previous devices require multiple devices to accomplish a single clean up task. The present mitt 10 solves this problem, and more especially does so in the areas of the mitt 10 where most needed. A less complete example of the mitt 10 features at least the thumb surround 15 and the opposed digit surround 14 with outer absorbent layers 18 and inner highly absorbent layers 19. The thumb surround 15 and digit surrounds 14 are most typically used to clean hard to reach areas of a baby or of an individual where soiling is greatest. Again, the preferred embodiment includes the non-abrasive pad 30 (FIG. 5) on the digit surround 14 opposed to the thumb surround 15.

Referring to FIG. 3, the elastic band 20 is proximal to where the absorbent layer 18 meets the extension of the impermeable lining 16. The impermeable lining 16 extends beyond and above a user's wrist to prevent soiling materials from entering the mitt 10 and soiling a user.

Referring to FIG. 4, the most basic example of the mitt 10 illustrates bonding of the impermeable lining 16 with the absorbent layer 18 in the thumb surround 14. The two-layer construction proceeds throughout this most basic example of the invention 10, excepting the extension of the impermeable lining 16 which extends beyond the elastic band 20 region of the mitt 10.

Referring to FIG. 5, the digit surround 14 is complete with the textured non-abrasive pad 30 surrounding the outer absorbent layer 18. This is the same digit surround 14 illustrated in embodiment A in FIG. 1 which opposes the thumb digit surround 15. Cleaning delicate areas often requires an extra gentle touch to insure against aggravation, irritation, and even, rashes, especially with infants. This added feature of the slightly ruffled textured non-abrasive pad 30 offers a further convenience.

With respect to the above description then, it is to be realized that the optimum dimensional relationships for the parts of the baby-wipe mitt, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

What is claimed is:

1. A baby-wipe mitt with a thumb surround and an opposed digit surround, for cleaning babies' bodies and for use in cleaning invalids and others needing care, the mitt comprising:

a first highly flexible inner lining of an impermeable material;

a flexible highly absorbent layer bonded to the inner lining;

an outer layer of flexible absorbent material, the outer layer bonded to the highly absorbent layer;

an opening at a bottom of the mitt for the removable insertion of an individual's hand;

an elasticized material encircling an approximate base of the mitt, the elasticized material proximal to an individual's wrist, the elasticized material to form a barrier against material invasions within the mitt;

a first portion of the mitt for receiving more than one finger of an individual;

a thumb surround angularly joined to the first portion of the mitt, the thumb surround for removable receipt of a thumb of the individual's hand;

a second digit surround, the second digit surround for the removable receipt of a second digit of the hand, the second digit opposed to the thumb;

a textured non-abrasive pad bonded to the outer absorbent layer of only the second digit surround, the pad for further non-irritational cleaning of sensitive areas.

2. The mitt in claim 1 wherein the outer layer of absorbent material is treated with a moist anti-bacterial, anti-fungal agent.

3. The mitt in claim 2 wherein the inner impermeable layer extends beyond and above the individual's wrist, thereby offering protection against invasive materials.

4. The mitt in claim 1 wherein both the highly absorbent layer and the outer absorbent layer are treated with a moist anti-bacterial, anti-fungal agent.

5. The mitt in claim 4 wherein the inner impermeable lining extends beyond and above the individual's wrist, thereby offering protection against invasive materials.

6. The mitt in claim 1 wherein the highly absorbent layer is treated with a moist anti-bacterial, anti-fungal agent.

7. The mitt in claim 6 wherein the non-abrasive pad is treated with a moist anti-bacterial, anti-fungal agent.

8. The mitt in claim 7 wherein the inner impermeable lining extends beyond and above the individual's wrist, thereby offering protection against invasive materials.

9. The mitt in claim 6 wherein the inner impermeable lining extends beyond and above the individual's wrist, thereby offering protection against invasive materials.

10. The mitt in claim 1 wherein the inner impermeable lining extends beyond and above the individual's wrist, thereby offering protection against invasive materials.

* * * * *